US005778899A

United States Patent [19]

Saito et al.

[11] Patent Number: 5,778,899

[45] Date of Patent: Jul. 14, 1998

[54] SMOKING ARTICLE

[75] Inventors: Yutaka Saito; Yuriko Anzai; Ryuichi Suzuki; Hiroshi Ichinose, all of Yokohama, Japan

[73] Assignee: Japan Tobacco Inc., Tokyo, Japan

[21] Appl. No.: 530,105

[22] PCT Filed: Jan. 26, 1995

[86] PCT No.: PCT/JP95/00091

§ 371 Date: Sep. 26, 1995

§ 102(e) Date: Sep. 26, 1995

[87] PCT Pub. No.: WO95/20330

PCT Pub. Date: Aug. 3, 1995

[30] Foreign Application Priority Data

Jan. 26, 1994 [JP] Japan ..... 6-007066

[51] Int. Cl.[6] ..... A24B 15/12

[52] U.S. Cl. ..... 131/352; 131/194; 131/359

[58] Field of Search ..... 131/194, 352, 131/359, 274–279, 353, 357, 369

[56] References Cited

U.S. PATENT DOCUMENTS

| | | | |
|---|---|---|---|
| 4,109,663 | 8/1978 | Maeda et al. . | |
| 4,256,126 | 3/1981 | Seligman et al. | 131/353 |
| 4,518,581 | 5/1985 | Miyake et al. | 131/274 X |

FOREIGN PATENT DOCUMENTS

| | | |
|---|---|---|
| 51-128500 | 11/1976 | Japan . |
| 53-104742 | 9/1978 | Japan . |
| A-53--133697 | 11/1978 | Japan . |
| 59-32108 | 8/1984 | Japan . |
| 59-41397 | 10/1984 | Japan . |
| 59-41398 | 10/1984 | Japan . |
| 60-14761 | 4/1985 | Japan . |
| 1-289457 | 11/1989 | Japan . |

*Primary Examiner*—V. Millin
*Assistant Examiner*—William J. Deane, Jr.
*Attorney, Agent, or Firm*—Birch, Stewart, Kolasch & Birch, LLP

[57] ABSTRACT

A smoking article has a flavor-generating material as a burnable smoking element. The flavor-generating material includes a flavoring component-holding material formed of a heat-irreversibly gelled glucan and a flavoring component held in the holding material, and is obtained by thermally gelling a mixture of ungelled glucan and the flavoring component added thereto. Since the flavoring component is firmly fixed and held within the three-dimensional network structure of the gelled glucan, the storage properties and release-durability of the flavoring component are improved.

25 Claims, 1 Drawing Sheet

SMOKING ARTICLE

TECHNICAL FIELD

The present invention relates to a smoking article, and more particularly to a smoking article containing a flavor-generating material which is capable of stably retaining the flavoring components, and at the same time capable of readily releasing the flavoring components when it is burned, without generating any obnoxious taste and smell.

BACKGROUND ART

A tobacco article is a representative smoking article, which includes dried leaf tobacco as a main smoking material and in which the flavor is generated by burning the material which is tasted through gustatory or olfactory organs of human. In tobacco articles, a flavor-generating material containing flavoring components has been conventionally employed for the purpose of improving the taste of tobacco.

However, the conventional flavor-generating materials are poor in stably retaining the flavoring components. Therefore, the smoking articles containing the conventional flavor-generating material have a tendency that its flavoring components escape through vaporization when the articles are stored for a long period of time, and the flavors can not be tasted stably during smoking. Meanwhile, it is required that the flavor-generating material do not generate obnoxious taste and smell upon burning.

Accordingly, an object of the present invention is to provide a smoking article containing a flavor-generating material which is capable of stably retaining the flavoring components, and at the same time capable of readily releasing the flavoring components when it is burned, without generating any obnoxious taste and smell.

DISCLOSURE OF THE INVENTION

To achieve the above object, a heat-irreversibly coagulating glucan which has been heat-irreversibly gelled is used in the present invention as a holding material for holding a flavoring component or components, in a flavor-generating material. Flavoring components are added beforehand to an ungelled glucan (usually in the form of a dispersion in water), and the mixture is then subjected to gelation of the glucan by heating. Thus, the flavoring components are incorporated or entrapped within the three-dimensional network of the glucan molecules and strongly fixed therein. The flavor-generating material containing this heat-irreversible gel of the glucan as a holding material for the flavoring components is capable of firmly fixing and retaining the flavoring components under the ordinary storage conditions, and of readily releasing a sufficient amount of the flavoring components when it is burned (i.e. it releases a sufficient amount of flavoring component only if burned: for the generation of flavor). In addition, the flavor-generating material does not generate any obnoxious taste or smell upon burning. The smoking article of the present invention has a burnable smoking element which comprises this flavor-generating material and optionally cut tobacco and/or cut tobacco substitute. Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
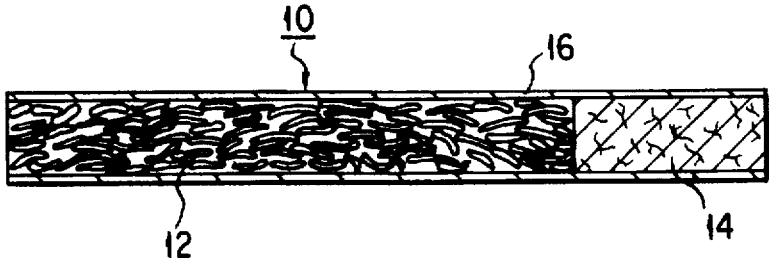
FIG. 1 is a sectional view schematically showing one embodiment of a smoking article according to the present invention.

The present inventors have conducted extensive studies in an attempt to develop a non-tobacco flavor-generating material which is excellent in retention stability of flavoring components under ordinary storage conditions is capable of readily releasing a sufficient amount of flavoring components when it is burned, without accompanying the generation of an obnoxious taste and smell. As a result, it has been found that the above object can be achieved by the use of a heat-irreversible gel of a heat-irreversibly coagulating glucan such as β-1,3-glucan, for example, curdlan, as a holding material for the flavoring components. Further studies have revealed that the retention of the flavoring components as well as the durability of release of the flavoring components during burning can be greatly improved, if a flavoring component or components are added to the glucan prior to the gelation of the glucan rather than adding the flavoring components to the glucan after the glucan is thermally gelled. Namely, if the flavoring components are added to the glucan prior to the gelation of the glucan and then the gelation of the glucan is performed, the flavoring components can be incorporated or entrapped within the three-dimensional network of the glucan molecules so as to be firmly fixed and held therein. On the other hand, if flavoring components are added to glucan after the glucan is gelled, the flavoring components are merely physically adhered onto the fine pores of the glucan gel so that the release durability of the flavoring components during burning is lowered.

The glucan used in the present invention is known per se in the art. For example, curdlan, which is most preferably used in the present invention, is a straight-chain β-1,3-glucan wherein about 400 to 500 D-glucose molecules are linked together through a β-glucosidic linkage at 1–3 position, and is insoluble in water and in most organic solvents. Moreover, the glucan is safe to human beings (for example, Unexamined Japanese Patent Application Publication 1-289457 discloses preparing an edible film by mixing a β-1,3-glucan such as curdlan with a water-soluble high molecular material). Glucan is commercially available, usually in the form of powder.

When β-1,3-glucan, in the form of a dispersion in water, is heated above the critical gelation temperature thereof (in the case of curdlan, 80° C. or more), it is gelled. The resultant gel will never be melted again even if it is heated (heat-irreversible gel).

The present inventors have found out that such a heat-irreversible gel of a heat-irreversibly coagulating glucan, such as a β-1,3-glucan, is capable of firmly holding and retaining flavoring components therein, but capable of readily releasing the flavoring components as it is burned, without generating substances during burning, which adversely affect the released flavor, such as obnoxious stimulating, pungent or fibrous smelling substances.

The flavoring component used in the flavor-generating material of the invention is preferably liquid or solid (i.e., not gaseous) at a temperature at which the aqueous dispersion of a heat-irreversibly coagulating glucan is prepared, which will be described later. There is particularly no restriction as to the kind of flavoring component used, as far as its flavor can satisfy the taste of a human through its gustatory or olfactory organs. Any hydrophilic or hydrophobic flavoring components may be used. Examples of hydrophilic flavoring component are leaf tobacco extract, natural plant extract (for example, licorice extract, Saint-john's bread extract, plum extract, peach extract and the like), acids (for example, malic acid, tartaric acid, citric acid and the like), saccharides (for example, glucose, fructose, isomerized sugar and the like), and nicotine salts (for example, nicotine citrate and the like). Examples of hydrophobic flavoring component are tobacco powder, menthol, cocoas (powder, extract and the like), esters (for example, iso-amyl acetate, linalyl acetate, iso-amyl propionate, linalyl butyrate and the like), natural essential oils (plant essential oils such as vanilla extract, spearmint, peppermint, cassia, jasmine; and animal essential oils such as musk, amber, civet, castoreum and the like), and single incense (for example, anethole, limonene, linalol, eugenol and the like). These flavoring components may be employed singly a combination of two or more of these components.

The flavoring components may be used at any concentration in the flavor-generating material of the invention sufficient to satisfy the taste of a human through its gustatory or olfactory organs as the flavor-generating material is burned, and the concentration can be arbitrarily adjusted. More specifically, the flavoring component is present in an amount from a trace amount to 20% by weight, and preferably from 5 to 10% by weight in the final flavor-generating material.

To prepare a flavor-generating material of the invention, a glucan, usually in the form of powder, is first stirred in water at a high speed to obtain a dispersion (glucan slurry). The preparation of this dispersion is preferably performed by stirring the glucan with a mixer at a temperature of 20° to 30° C. A stable aqueous dispersion of glucan can be obtained in this manner. When the content of glucan such as curdlan is large, a slurry of high viscosity will result, thus making it more difficult to obtain a slurry which is easy to handle. In particular, when the flavor-generating material is to be prepared in the form of a sheet, the content of glucan, in particular curdlan, in an aqueous dispersion, should preferably be 1 to 20% by weight, and more preferably should be 3 to 5% by weight.

A desired flavoring component is then added at a desired ratio to the thus prepared aqueous dispersion of glucan, and mixed therein. In this case, if the flavoring component employed is hydrophobic, the hydrophobic component should preferably be preliminarily dissolved in an oily solvent (for example, vegetable fats and oils, or saturated fatty acid triglyceride), preferably together with an emulsifying agent which is known as a food additive (for example, glycerol fatty acid ester, sucrose fatty acid ester, sorbitan fatty acid ester, propylene glycol fatty acid ester and lecithin), to prepare a dissolution material, which is then mixed with the aqueous dispersion of glucan. The resultant mixture is then dispersed and emulsified through a high speed stirring as mentioned above. Among the above-mentioned oily solvents for hydrophobic flavoring components, a middle chain saturated fatty acid triglyceride (MCT) is particularly suited for use, since this substance is capable of readily dissolving most of hydrophobic flavoring components, excellent in oxidation stability as it does not contain unsaturated fatty acid components, and easy to handle owing to its low viscosity. Further, the use of emulsifying agent is effective in forming a satisfactory emulsion wherein the flavoring component is uniformly dispersed and retained therein.

In preparation of the above-mentioned dissolution material, a hydrophilic flavoring component may also be added thereto. In such a case, the hydrophobic flavoring component is dissolved in the oily solvent, and stabilized as a minute emulsion by means of a high speed stirring. On the other hand, the hydrophilic flavoring component is uniformly dispersed and stabilized in the aqueous dispersion of glucan of high-viscosity.

In order to impart a pliability to a resulting sheet, thereby facilitating peeling of the sheet from a casting support, it is preferable to add a softening agent comprising a polyhydric alcohol (for example, glycerin, propylene glycol) and/or a saccharide (for example, monosaccharides such as glucose and fructose; disaccharides such as maltose, saccharose and lactose; and polysaccharides such as cellulose and starch; and oxidation derivatives thereof such as aldonic acid and uronic acid) to the aqueous dispersion of glucan containing the flavoring component. By adjusting the ratio between the contents of polyhydric alcohols and saccharides, the softness of the resultant sheet can be adjusted.

The aqueous dispersion of glucan containing the flavoring component and other components, thus obtained, is then cast over a suitable casting support (such as a stainless steel belt) as a thin sheet after being subjected, if required, to a defoaming treatment under a reduced pressure. This thin sheet is then heat-dried at a temperature which enables the glucan to be heat-irreversibly gelled (for example, 80° C. to 140° C. in the case of curdlan). With this heating treatment, the water content of the thin sheet is reduced down to, for example, 10%, and at the same time the glucan is transformed into a heat-irreversible gel firmly fixing and keeping therein the flavoring component, thus obtaining a flavor-generating material of the present invention. The above-mentioned gelation is achieved only through heating, without using any gelling agent at all. As mentioned above, glucan is subjected according to the present invention to heat-gelation in the form of an aqueous dispersion. When glucan is subjected to heat-gelation as the aqueous dispersion, the flavor of the flavoring component is not adversely affected, in contrast to the case where glucan is subjected to heat-gelation in the form of an aqueous alkaline solution.

The flavor-generating material of the invention which comprises a glucan gel holding the flavoring component therein, thus obtained, can be easily peeled off from the casting support. If required, this glucan gel may be humidified and conditioned when it is peeled from the support.

The flavor-generating material of the present invention hardly releases the flavoring component contained therein under ordinary storage conditions (for example, at a temperature of 22° C. and under a relative humidity of 60%), but, if burned, readily releases the flavoring component, without generating any obnoxious taste or smell. Further, the flavor-generating material of the present invention is insoluble in water as well as in most of organic solvents, and unharmful.

The content of each component in the final flavor-generating material is preferably as follows:

The content of the glucan, in particular curdlan, ranges from 2 to 70% by weight, more preferably from 10 to 40% by weight. If the content of the glucan exceeds 70% by weight, the pliability of the resultant gel will tend to be lowered. On the other hand, if the content of the glucan is less than 2% by weight, the result will tend to be an incomplete formation of gel.

The content of the oily solvent is 30% by weight or less, preferably 5 to 15% by weight. If the content: of the oily solvent exceeds 30% by weight, it becomes impossible for the glucan gel to keep all of the oily solvent therein, so that some of the oily solvent will leak out of the glucan gel.

The content of the emulsifying agent is 30% by weight or less, preferably 5 to 15% by weight. If the content of the emulsifying agent exceeds 30% by weight, it becomes impossible for the glucan gel to keep all of the emulsifying agent therein, so that some of the emulsifying agent will leak out of the glucan gel as in the case of the oily solvent. Accordingly, it is preferable that the total of the oily solvent and emulsifying agent do not exceed 30% by weight. The optimum ratio between the oily solvent and emulsifying agent is 2:1.

The total amount of the polyhydric alcohol and saccharide is 50% by weight or less, more preferably 10 to 30% by weight (a saccharide serving also as a flavoring component can be used within this range).

The flavor-generating material of the present invention may be cut into fine pieces or pulverized into powder, and formed into a burnable smoking element optionally blended with cut tobacco and/or cut tobacco substitute, from which a burnable smoking article or cigarette can be prepared.

Alternatively and preferably, the cut or pulverized flavor-generating material of the invention is kneaded in an ordinary sheet tobacco raw material and formed into a sheet, which is then cut into fine pieces, or pulverized with a hammer mill. The resultant material may be used singularly or in combination with the other flavoring component (such as cut tobacco) to prepare a flavor-generating medium. A typical composition of the rolled sheet tobacco material containing the flavor-generating material of the invention comprises 100 parts by weight of tobacco powder (or cellulose or dolomite), 5 to 20 parts by weight of a reinforcing material (for example, tobacco fibers or pulp), 1 to 15 parts by weight of a binder (for example, carboxymethyl cellulose), 1 to 40 parts by weight, preferably 5 to 20 parts by weight of a flavor-generating material of the invention, and any required amount of water. This composition may optionally contain a suitable amount of a humectant (for example, glycerin) or a water-resistant agent (for example, glyoxal). The flavor-generating material of the invention may be kneaded into the other kinds of sheet tobacco such as a slurry sheet tobacco.

The smoking article of the present invention may be provided with a filter.

The content of flavor-generating material of the invention in the burnable smoking element may be such that the flavor released from the flavor-generating material of the invention may predominate, or such that the released flavor may be sufficient to mask any obnoxious taste or smell generating from the other substances.

FIG. 1 illustrates one embodiment of a smoking article of the present invention, having an ordinary cigarette shape. The cigarette 10 shown comprises a column portion 12 formed of the burnable smoking element described above, and a filter portion 14 formed of fibrous material and attached to one end of the column portion 12. The article is entirely wrapped with a wrapping paper 16. The distal end of the column portion 12 is lit to burn the burnable smoking element, and puffing is effected at the filter portion 14, thus allowing the flavor from the smoking element to be tasted.

The cigarette of the invention permits ready release of the flavoring component when burned, due to the above-noted properties of the flavor-generating material of the invention, thus allowing the flavor to be tasted immediately.

EXAMPLE 1

2 g of menthol and 2 g of lecithin were dissolved into 4 g of MCT to prepare a menthol-mixed solution. Meanwhile, 12 g of curdlan powder was dispersed in 288 g of water under the conditions of a stirring rotational speed of 3,000 rpm and a temperature of 25° C. To the resultant dispersion, the menthol-mixed solution was added, and the mixture was stirred for 5 minutes to prepare an emulsified dispersion. To this emulsified dispersion, 8 g of cocoa, 6 g of sorbitol (15% by weight based on the whole composition) and 6 g of glycerin (15% by weight based on the whole composition) were added, and stirred under the same conditions as above to prepare a curdlan slurry. The curdlan slurry was cast over a stainless steel belt as a sheet to a thickness of 0.5 mm to 1.0 mm and dried at 110° C. By this drying, the curdlan was heat-irreversibly gelled, holding and fixing the menthol therein. Then, the dried curdlan sheet was peeled off from the stainless steel belt, giving a flavor-generating material sheet of the present invention. The thickness of the sheet was 0.1 mm to 0.2 mm.

The flavor-generating material sheet prepared above was stored for 20 days under the conditions of 22° C. in temperature and 60% in relative humidity, and then subjected to the measurement of menthol concentration and an organoleptic test. The menthol concentration was measured by means of a gas chromatography. As a result, it was found that 95% or more of the menthol remained in the sheet even after 20 days of storage. The results of organoleptic evaluation of the sheet were almost the same as those evaluated before storage.

The flavor-generating material sheet was cut into pieces like cut tobacco, blended with puffed cut tobacco in the weight ratio of 7:3, and the blend was wrapped with a wrapping paper, in the form of a rod, thus preparing a cigarette, which was then smoked. As a result, it was found that the flavors of flavoring components including the menthol were generated immediately after the puffing, and a stable generation of the flavors was substantially maintained during 10 times of puffing. Further, any substances which may interfere with the flavors of the flavoring components including the menthol, such as obnoxious stimulating, pungent or fibrous smelling substances, were not generated from the sheet material formed mainly of the curdlan, during the burning of the sheet material.

EXAMPLE 2

12 g of curdlan powder was dispersed into 288 g of water under the same temperature and stirring conditions as those of Example 1, and then 0.5 g of licorice extract, a hydrophilic flavoring component, was added and dispersed therein. To the dispersion, 8 g of cocoa, 6 g of sorbitol and 6 g of glycerin were added and stirred under the same conditions to obtain a curdlan slurry. The curdlan slurry was treated in the same manner as in Example 1 to prepare a flavor-generating material sheet of the invention having licorice extract retained and fixed therein.

As in Example 1, a portion of the flavor-generating material sheet was stored for 20 days, and another portion was wrapped with a wrapping paper into a cigarette, which was smoked or puffed, for organoleptic evaluations.

The results of organoleptic evaluation of the sheet were almost the same as those evaluated before storage. Further, it was found that the flavors of the flavoring components including the licorice were generated immediately after the puffing, and a stable generation of the flavors was substantially maintained during 10 times of puffing. Further, any substances which may interfere with the flavors of the flavoring components including the licorice, such as obnoxious stimulating, pungent or fibrous smelling substances, were not generated from the sheet material formed mainly of the curdlan, during the burning of the sheet material.

EXAMPLE 3

0.1 g of spearmint oil, a hydrophobic flavoring component, and 2 g of lecithin were dissolved into 4 g of MCT to prepare a spearmint oil-mixed solution. Meanwhile, 12 g of curdlan powder was dispersed into 288 g of water under the same temperature and stirring conditions as those in Example 1. To the dispersion, the spearmint oil-mixed solution was added, and stirred for 5 minutes to emulsify it. To the emulsified dispersion obtained, 8 g of cocoa, 6 g of sorbitol and 6 g of glycerin were added and stirred under the same conditions to prepare a curdlan slurry. The curdlan slurry was treated in the same manner as in Example 1 to prepare a flavor-generating material sheet of the invention having spearmint oil retained and fixed therein.

The results of organoleptic evaluation of the sheet were almost the same as those evaluated before storage. Further, it was found that the flavors of flavoring components including the spearmint oil were generated immediately after the puffing, and a stable generation of the flavors was substantially maintained during 10 times of puffing. Further, any substances which may interfere with the flavors of the flavoring components including the spearmint oil, such as obnoxious stimulating, pungent or fibrous smelling substances, were not generated from the sheet material formed mainly of the curdlan, during the burning of the sheet material.

EXAMPLE 4

A spearmint oil-mixed solution was prepared in the same manner as in Example 3. Meanwhile, 12 g of curdlan powder was dispersed into 288 g of water under the same temperature and stirring conditions as those in Example 1. To the dispersion, the spearmint oil-mixed solution was added and stirred for 5 minutes, and emulsified to prepare a curdlan slurry. The curdlan slurry was gradually heated, while stirring, to remove the water therefrom, and gelled by raising the temperature up to 110° C. The curdlan was heat-irreversibly gelled, holding and fixing the spearmint oil therein. The curdlan gel thus obtained was vacuum-dried and then pulverized with a hammer mill to prepare a powdery flavor-generating material of the invention.

As a control, 12 g of curdlan powder was dispersed into 288 g of water under the same temperature and stirring conditions as those in Example 1. Subsequently, this curdlan slurry was gradually heated under stirring to remove the water therefrom, and then was gelled by raising the temperature up to 110° C. to gel the curdlan. Then, a spearmint oil-mixed solution prepared in the same manner as in Example 1 was added to the curdlan gel thus obtained, then vacuum-dried and pulverized with a hammer mill to prepare a powdery flavor-generating material.

Figure 2:
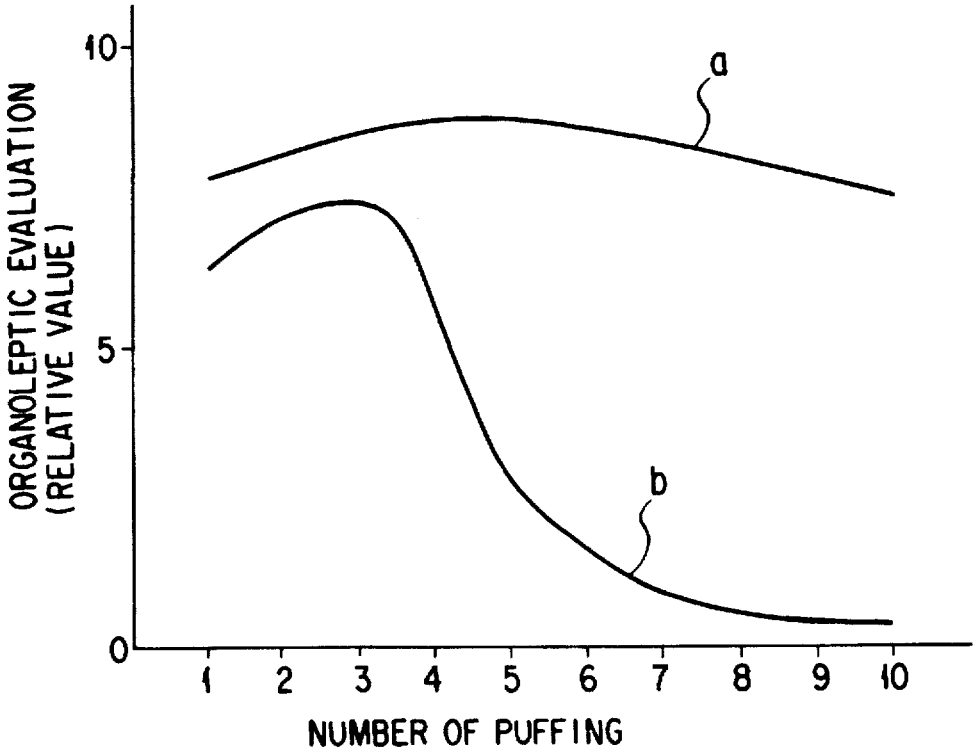
FIG. 2 is a graph showing the result of organoleptic evaluation of a smoking article of the present invention in comparison with that of a control.

Samples of cigarette were prepared in the same manner as in Example 1, using these powdery flavor-generating materials, and smoked. As a result, the cigarette prepared from the flavor-generating material of the present invention generated the flavor of spearmint oil immediately after the puffing, and a stable generation of the flavor was substantially maintained during 10 times of puffing (FIG. 2, curve a). Further, the generation of any substances which may interfere with the flavor of the spearmint oil, such as obnoxious stimulating, pungent or fibrous smelling substances were not generated from the flavor-generating sheet material mainly formed of the curdlan, during smoking. In the case of the cigarette prepared using the flavor-generating material of the control, however, the flavor of spearmint oil was suddenly reduced from the fourth puffing, and the flavor of spearmint oil could not be tasted after the fifth puffing (FIG. 2, curve b).

EXAMPLE 5

A spearmint oil-mixed solution was prepared in the same manner as in Example 3. Meanwhile, 12 g of curdlan powder was dispersed into 288 g of water under the same temperature and stirring conditions as those in Example 1. To the resultant dispersion, the spearmint oil-mixed solution and 0.5 g of licorice extract were added and stirred for 5 minutes to emulsify them. To the emulsified dispersion obtained, 8 g of cocoa, 6 g of sorbitol and 6 g of glycerin were added, and stirred under the same conditions to prepare a curdlan slurry. The curdlan slurry was treated in the same manner as in Example 1 to prepare a flavor-generating material sheet of the present invention having spearmint oil and licorice extract retained and fixed therein.

As in Example 1, a portion of the flavor-generating material sheet was stored for 20 days, and another portion was wrapped with a wrapping paper into a cigarette, which was smoked or puffed for organoleptic evaluations.

The results of organoleptic evaluation of the sheet were almost the same as those evaluated before storage. Further, it was found that the flavors of flavoring components including the spearmint oil and licorice extract were generated immediately after the puffing, and a stable generation of the flavors was substantially maintained during 10 times of puffing. Further, any substances which may interfere with the flavors of the flavoring components including the spearmint oil and licorice extract, such as obnoxious stimulating, pungent or fibrous smelling substances, were not generated from the sheet material mainly formed of the curdlan, during the burning of the sheet material.

EXAMPLE 6

A menthol-mixed solution was prepared in the same manner as in Example 1. Meanwhile, 12 g of curdlan powder was dispersed into 288 g of water under the same temperature and stirring conditions as those in Example 1. To the resultant dispersion, the menthol-mixed solution was added and stirred for 5 minutes to emulsify them. To the emulsified dispersion obtained, 4 g of sorbitol (10% by weight based on the whole composition), 8 g of glycerin (20% by weight based on the whole composition) and then 8 g of cocoa powder were added, and the resultant mixture was stirred under the same conditions to prepare a curdlan slurry. The curdlan slurry was treated in the same manner as in Example 1 to prepare a flavor-generating material sheet of the present invention.

Additionally, another flavor-generating material sheet of the present invention was prepared in the same manner as mentioned above except that the amount of sorbitol was changed to 8 g (20% by weight based on the whole composition), and the amount of glycerin was changed to 4 g (10% by weight based on the whole composition).

These sheets and the sheet prepared in Example 1 were compared with respect to the pliability thereof. As a result, it was found that when the weight ratio of sorbitol/glycerin was 10/20, the pliability of the sheet was increased so that a soft sheet excellent in elasticity could be obtained, and that when the weight ratio of sorbitol/glycerin was 20/10, the pliability of the sheet was decreased so that the sheet which was obtained was hard. Further, as a result of examination of these sheets, it was found that when the weight ratio of sorbitol/glycerin was 15/15, a sheet excellent in releasability and optimum in pliability could be obtained.

EXAMPLE 7

The flavor-generating material sheet obtained in Example 3 was cut into fine pieces.

On the other hand, 8.5 kg of a mixture of fine power generated during the manufacture of tobacco in a tobacco manufacturing factory and waste material from a winnower was pulverized into powder through a mill. To this powder, 1.5 kg of pulp as a reinforcing material and 1 kg of carboxymethyl cellulose as a binder were added, and the resultant mixture was thoroughly mixed to obtain a powdery mixture. To the powdery mixture, 1.5 kg of the fine pieces of flavor-generating material sheet mentioned above, 1 kg of a mixture of polypropylene glycol and corn syrup as a humectant and 3 kg of water were added, and the resultant mixture was thoroughly mixed to prepare a uniform wet mass. The mass was passed through a pair of molding rollers, the interior of each being circulated with a hot water heated to 80° C., thereby molding a thin film. The thin film thus molded was successively peeled from the roller with a doctor knife, and transferred by means of wire mesh conveyer running below the rollers to a drying chamber and a conditioning chamber. Thus, a sheet tobacco material containing 15% of water was obtained.

As in Example 1, a portion of the sheet tobacco material was stored for 20 days, and another portion was wrapped with a wrapping paper into a cigarette, which was smoked or puffed for organoleptic evaluations.

The results of organoleptic evaluation of the sheet were almost the same as those evaluated before storage. Further, it was found that the flavors of flavoring components including the spearmint oil were generated immediately after the puffing, and a stable generation of the flavors was substantially maintained during 10 times of puffing. Further, any substances which may interfere with the flavors of the flavoring components including the spearmint oil, such as obnoxious stimulating, pungent or fibrous smelling substances, were not generated from the sheet material mainly formed of the curdlan, during the burning of the sheet material.

As has been described above, it is possible according to the present invention to provide a smoking article containing a flavor-generating material which is excellent in storage stability of a flavoring component contained therein and capable of readily releasing the flavoring component when it is burned, without giving off any obnoxious taste and smell. Further, it is possible to easily manufacture the flavor-generating material by a simple process. Furthermore, a smoking article or cigarette containing a flavor-generating material of the invention readily release the flavoring component in the flavor-generating material when it is burned so as to satisfy the taste of a smoker through his gustatory or olfactory organs. The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A smoking article having a burnable smoking element, said smoking element comprising:

a flavor-generating material including a flavor component-holding material formed of a heat-irreversibly coagulating glucan which has been heat-irreversibly gelled and a flavoring component held in said holding material;

said smoking element having been obtained by thermally gelling a mixture of an ungelled heat-irreversibly coagulating glucan and the flavoring component added thereto, and being capable of releasing the flavoring component through burning;

wherein the flavoring component contains a hydrophobic flavoring component, and the flavor-generating material comprises an oily solvent for the hydrophobic flavoring component.

2. The smoking article according to claim 1, wherein the glucan is β-1,3-glucan.

3. The smoking article according to claim 1, wherein the glucan is curdlan.

4. The smoking article according to claim 1, wherein said smoking element further comprises cut tobacco and/or cut tobacco substitute.

5. The smoking article according to claim 1, wherein the oily solvent is a middle chain saturated fatty acid triglyceride.

6. The smoking article according to claim 1, wherein the flavor-generating material further contains an emulsifying agent.

7. The smoking article according to claim 1, wherein the flavoring component further contains a hydrophilic flavoring component.

8. The smoking article according to claim 1, wherein the flavor-generating material contains a softening agent including a polyhydric alcohol or a saccharide.

9. The smoking article according to claim 1, wherein the gelation is carried out in absence of a gelling agent.

10. A burnable smoking element comprising:

a flavor-generating material including a flavor component-holding material formed of a heat-irreversibly coagulating glucan which has been heat-irreversibly gelled and a hydrophobic flavoring component held in said holding material;

said smoking element having been obtained by thermally gelling a mixture containing an ungelled heat-irreversibly coagulating glucan, the flavoring component, an oily solvent for the flavoring component and an emulsifying agent;

said smoking element being capable of releasing the flavoring component upon burning.

11. The smoking element according to claim 10, wherein said oily solvent is a vegetable fat or oil, or a middle chain saturated fatty acid triglyceride.

12. The smoking element according to claim 10, wherein said emulsifying agent is selected from glycerol fatty acid ester, sucrose fatty acid ester, sorbitan fatty acid ester, propylene glycol fatty acid ester and lecithin.

13. The smoking element according to claim 10, wherein said flavor-generating material further comprises a softening agent comprising a polyhydric alcohol or a saccharide.

14. A burnable smoking element in the form of a molded sheet, said molded sheet comprising a cut or pulverized flavor-generating material and tobacco material, said favor-generating material comprising:

heat-irreversibly gelled glucan and a flavoring component;

said flavor-generating material having been obtained by thermally gelling a mixture containing an ungelled heat-irreversibly coagulating glucan and said flavoring component, and cutting or pulverizing the gelled mixture; and said molded sheet having been obtained by blending the flavor-generating material with the tobacco material, and molding the blend into said molded sheet;

wherein said flavoring component comprises a hydrophobic flavoring component, and said flavor-generating material contains an oily solvent for the hydrophobic component.

15. The smoking element according to claim 14, wherein said ungelled glucan is β-1,3-glucan.

16. The smoking element according to claim 15, wherein said ungelled glucan is curdlan.

17. The smoking element according to claim 14, wherein said flavoring component comprises a hydrophilic flavoring component.

18. The smoking element according to claim 14, wherein said oily solvent is a middle chain saturated fatty acid triglyceride.

19. The smoking element according to claim 14, wherein said flavor-generating material contains an emulsifying agent.

20. The smoking element according to claims 19, wherein said emulsifying agent is selected from glycerol fatty acid ester, sucrose fatty acid ester, sorbitan fatty acid ester, propylene glycol fatty acid ester and lecithin.

21. The smoking element according to claim 14, wherein said flavor-generating material further comprises a softening agent comprising a polyhydric alcohol or a saccharide.

22. The smoking element according to claim 14, wherein said tobacco material is tobacco powder.

23. The smoking element according to claim 22, which contains 1 to 40 parts by weight of the flavor-generating material based on 100 parts by weight of tobacco powder.

24. The smoking element according to claim 22, which contains 5 to 20 parts by weight of the flavor-generating material based on 100 parts by weight of tobacco powder.

25. The smoking element according to claim 14, further comprising a humectant.

* * * * *